United States Patent [19]

Preis

[11] Patent Number: 4,581,898

[45] Date of Patent: Apr. 15, 1986

[54] SMALL THERMOELECTRIC COOLER

[76] Inventor: Alfred Preis, An der B 410, 5569 Boxberg, Fed. Rep. of Germany

[21] Appl. No.: 696,127

[22] Filed: Jan. 29, 1985

[30] Foreign Application Priority Data

Aug. 29, 1984 [DE] Fed. Rep. of Germany ..... 3431693

[51] Int. Cl.[4] ..... F25B 21/02

[52] U.S. Cl. ..... 62/3; 62/457

[58] Field of Search ..... 62/3, 457

[56] References Cited

U.S. PATENT DOCUMENTS

| | | | |
|---|---|---|---|
| 2,991,628 | 7/1961 | Tuck | 62/3 |
| 2,996,889 | 8/1961 | Roeder, Jr. | 62/3 |
| 3,310,953 | 3/1967 | Rait | 62/3 |
| 3,402,561 | 9/1968 | Mahoney | 62/3 |
| 3,808,825 | 5/1974 | Ciurea | 62/3 |
| 4,143,711 | 3/1979 | Beitner | 62/3 X |
| 4,295,345 | 10/1981 | Atkinson | 62/457 X |
| 4,297,850 | 11/1981 | Reed | 62/3 |
| 4,346,562 | 8/1982 | Beitner | 62/457 X |

*Primary Examiner*—Lloyd L. King

*Attorney, Agent, or Firm*—Ward Brown; Robert W. Beach

[57] ABSTRACT

A one piece metal cooling container has one or more upright cavities open at the top for reception of material to be cooled. A Peltier effect cooling element has one working surface in heat-conductive contact with the cooling container and an opposite working surface in heat-conductive contact with a heat sink. The heat sink has spaced cooling ribs projecting from the surface of the heat sink opposite its surface in contact with the Peltier element.

4 Claims, 4 Drawing Figures

SMALL THERMOELECTRIC COOLER

BACKGROUND OF THE INVENTION

1. Field of the Invention

The present invention relates to a small Peltier effect refrigeration unit.

2. Prior Art

Cooling appliances have been proposed for use in automobiles to keep beverages in standard beverage containers cool. Such proposed cooling appliances, however, are bulky and/or of limited cooling capacity.

SUMMARY OF THE INVENTION

The principal object of the present invention is to provide a cooling appliance powered by electricity, in compact form suitable for convenient use in an automobile and effective to cool beverages in standard beverage containers to a desired low temperature.

In the preferred embodiment of the present invention, the foregoing object is accomplished by providing a small thermoelectric cooler operating in accordance with the Peltier effect and having a one piece upright cooling container of heat-conductive metal material into which a standard beverage container may be inserted. The cold working surface of a Peltier effect cooling element is planar and engaged against a planar exterior surface of the cooling container with no intervening parts. A metal heat sink is arranged in heat-conductive contact with the hot working surface of the Peltier element opposite the cooling container and has cooling ribs projecting oppositely from the cooling container. An electric fan can be mounted adjacent to the heat sink to circulate air over its cooling ribs and therebe promptly and effectively dissipate heat.

DETAILED DESCRIPTION

Figure 1:
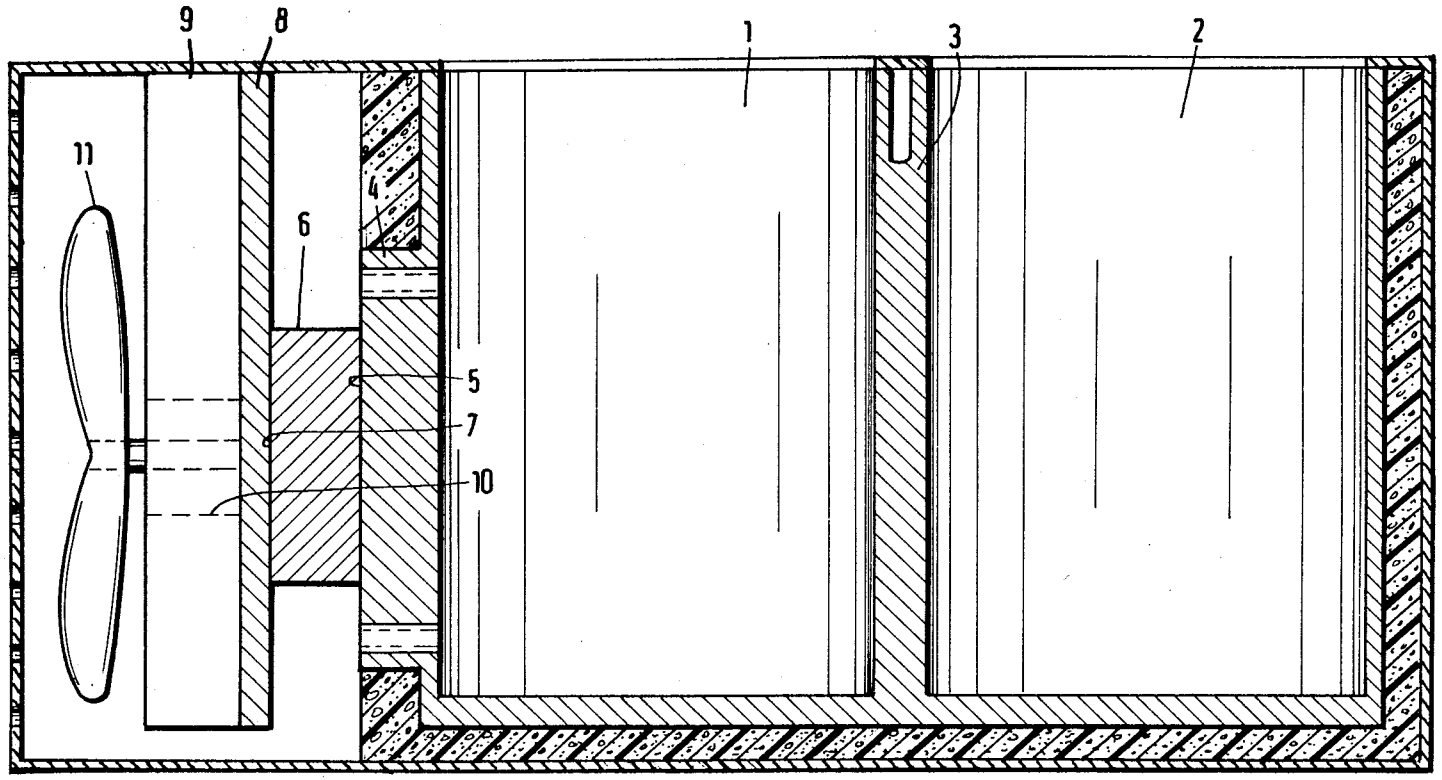
FIG. 1 is a somewhat diagrammatic, central, longitudinal, vertical section through a small thermoelectric cooler in accordance with the present invention.
Figure 2:
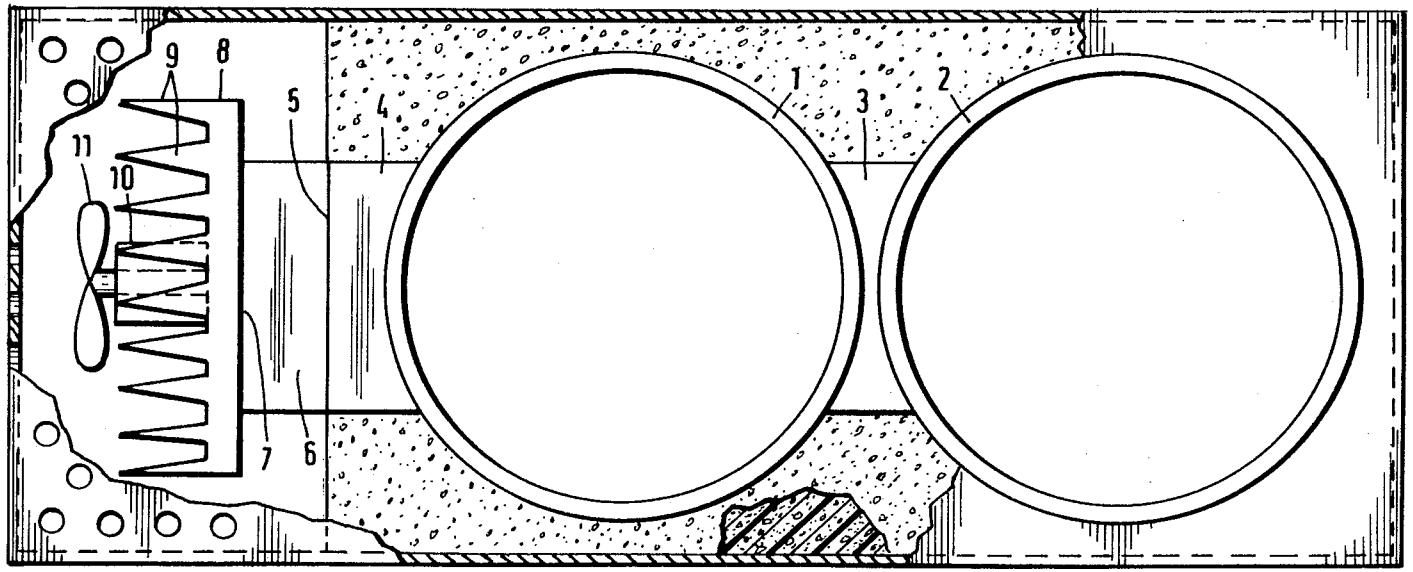
FIG. 2 is a somewhat diagrammatic top plan of the cooler of FIG. 1 with parts broken away.

As shown in FIG. 1, the preferred small thermoelectric cooler in accordance with the present invention includes a one-piece cooling container C of heat-conductive metal material such as aluminum. Such container has two upright cylindrical cavities 1 and 2, respectively, each encircled by the heat-conductive metal material, closed at the bottom and joined to the other cavity by the integral intermediate section 3 extending between the two cavities. Each cylindrical cavity is open at the top and is of a cross section only slightly greater than the outside diameter of a standard beverage container such as a 12-ounce aluminum can.

One end portion 4 of the cooling container projects longitudinally outward from cavity 1 in a direction registered with an upright plane intersecting the axes of the two cavities. Such end portion 4 has a planar, upright, external surface 5 perpendicular to such axial plane. A Peltier effect cooling element 6 has one large flat upright working surface in heat-conductive contact with the planar end surface 5 of the cooling container.

A heat sink 8 has a planar, upright, inner surface in heat-conductive contact with the other planar working surface 7 of the Peltier element 6 opposite its surface in contact with the cooling container. The heat sink has transversely-spaced upright cooling ribs 9 projecting longitudinally of the cooler away from the Peltier element 6.

Figure 3:
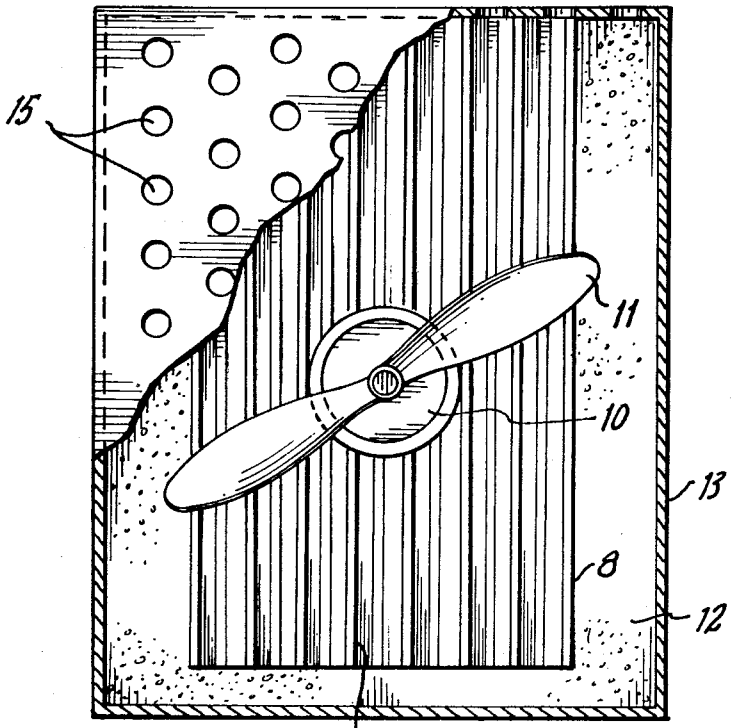
FIG. 3 is a somewhat diagrammatic end elevation of the cooler of FIG. 1 with parts broken away.

As best seen in FIG. 3, a circular section of the cooling ribs 9 is cut away in the center of the heat sink to form a recess for the small electric motor 10 of a fan having rotating air-circulating vanes 11 passing closely adjacent to the free ends of the cooling ribs 9.

Figure 4:
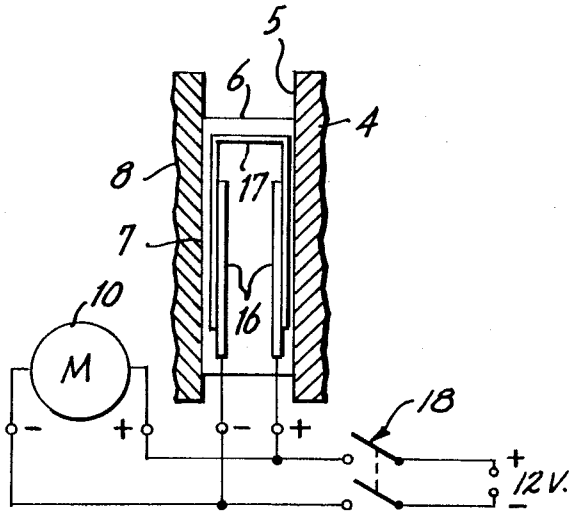
FIG. 4 is a diagram of a representative electrical circuit for the cooler of FIG. 1.

A representative internal structure of the Peltier element 6 is shown diagrammatically in FIG. 4. Strips, wires, rods or plates 16 of one appropriate metal material extend, respectively, along the opposite sides of the Peltier element. A strip, wire, rod or plate 17 of an appropriate different metal material connects the two pieces 16. As an example, one of the metal materials can be antimony and the other bismuth. There is a long junction of contact between the two metal materials at opposite sides of the Peltier element. Preferably such sides are formed by thin ceramic plates to electrically isolate the pieces 16 and 17 from the cooling container and the heat sink. A single switch 18 can be provided to control the supply of electrical power to the Peltier cooling element and to the fan motor 10.

In use, the beverage containers to be cooled are inserted into the cooling container cavities 1 and 2, an electrical current is induced in the appropriate direction across the Peltier element 6 and the cooling fan is turned on. Heat is extracted from the planar surface 5 of the cooling container, and heat is dissipated at the outer surface 7 of the Peltier element by the heat sink 8 which is continuously cooled by air circulated over the cooling ribs 9.

Preferably, at least the sides and bottom of the cooling container are surrounded by insulating foam 12. Since the beverage containers are snugly enclosed in the cooling cavities, an effective cooling of such containers is assured as heat is extracted from the end of the cooling container adjacent to the Peltier element. In addition, a good heat transfer is assured because of the one-piece construction of the container.

The cavity 2 remote from the Peltier element can be used as a precooler, while the cavity 1 adjacent to the Peltier element can be used as the final or main cooler.

Preferably the upright transverse area of the heat sink 8 is at least approximately equal to the horizontal cross-sectional area of each cooling container for effective dissipation of heat. The use of the parallel cooling ribs assures more rapid and reliable dissipation of heat as air is circulated over the ribs by the fan.

The entire cooler can be mounted in a small rectangular housing 13 having circular top openings 14 registered with the cooling container cavities. Preferably, the housing has apertures 15 in its top, sides and end portions enclosing the fan and the heat sink for intake and exhaust of air circulated by the fan over the cooling ribs.

By reversing the direction of the electrical current, the cooler can also be used for heating.

I claim:

1. In a small thermoelectric cooler for material to be cooled, a cooling container having an upright cavity for the material to be cooled, said cavity having a closed bottom and an open top and said container being of one piece construction of heat conductive metal material with integral upright side and bottom portions forming said cavity, said container including an end portion projecting generally horizontally away from said cavity, integral with the remainder of said container and having an upright planar surface remote from said cavity, a Peltier element having hot and cold working surfaces, the cold working surface of the Peltier element being in heat-conductive contact with said upright planar surface of said cooling container projecting end portion, and a heat sink having a surface in heat-conductive contact with the hot working surface of the Peltier element, said heat sink having cooling ribs projecting in a direction away from said Peltier element.

2. In the cooler defined in claim 1, a portion of the cooling ribs of the heat sink being cut away to form a recess, and electric fan means for circulating air over the cooling ribs, said fan means having a motor mounted in said recess and air-circulating vanes rotated by said motor and passing closely adjacent to the cooling ribs.

3. In the cooler defined in claim 2, the recess being formed in the central portion of the heat sink substantially directly opposite the surface of the heat sink in contact with the Peltier element.

4. In the cooler defined in claim 1, the cooling container having a second cavity and an integral intermediate section extending between the two cavities.

* * * * *